United States Patent [19]

Hwang

[11] Patent Number: 4,915,521

[45] Date of Patent: Apr. 10, 1990

[54] MECHANICAL PENCIL WITH ROTARY DISCHARGE MEMBER

[75] Inventor: Lee-Fen Hwang, Shin-Ying, Taiwan

[73] Assignee: Saint Island International Patent and Law Offices, Taipei, Taiwan

[21] Appl. No.: 367,936

[22] Filed: Jun. 19, 1989

[30] Foreign Application Priority Data

Sep. 25, 1987 [TW] Taiwan ..... 76209381

[51] Int. Cl.[4] ..... B43K 21/14

[52] U.S. Cl. ..... 401/56; 401/57; 401/85

[58] Field of Search ..... 401/75, 85, 44, 45, 401/56, 57, 65

[56] References Cited

U.S. PATENT DOCUMENTS 2,176,050 10/1939 Bailey ..... 401/56

2,561,509 7/1951 Harris ..... 401/56

*Primary Examiner*—Richard J. Johnson

*Attorney, Agent, or Firm*—Christie, Parker & Hale

[57] ABSTRACT

A mechanical pencil includes a tube-like housing having lead cavities annularly provided around an operating central rod. Leads from the cavities are discharged into a lead guiding passage through a rotary lead discharge member which is provided above the lead guiding passages and has a lead discharge passage. The lead discharge member is cooperatively associated with the rod so as to turn, upon depression of the rod, between a first position in which the lead enters the lead discharge passage from one of the lead cavities and a second position in which the lead enters the lead guide passage from the lead discharge passage.

10 Claims, 7 Drawing Sheets

MECHANICAL PENCIL WITH ROTARY DISCHARGE MEMBER

BACKGROUND OF THE INVENTION

This invention relates to a mechanical pencil with a plurality of aligned sharpened leads provided therein, and particularly to a mechanical pencil which has a tubular housing with annularly provided elongated lead cavities and a rotary lead discharge member to discharge leads from the lead cavities to a lower lead guide passage which extends to a lead outlet.

An object of the invention is provide a pencil which accommodates a greater number of leads than conventional pencils.

SUMMARY OF THE INVENTION

According to the invention, a mechanical pencil comprises a tube-like housing having an elongated central cavity and a plurality of elongated lead cavities annularly provided around the central cavity, the lead cavities being adaptable for receiving aligned leads with their sharpened ends directed downward, the housing further having a lead discharge member receiving cavity below the central cavity and the lead cavities. The tapered end portion has a lead guiding passage means below the lead discharge member receiving cavity and a lead outlet. An operating rod is movably received in the central cavity and extends into the lead guiding passage means. A means for urging the rod to move upward is provided in the upper side of the tubular housing. A lead discharge member is provided in the lead discharge member receiving cavity, having a bore to permit the rod to pass therethrough and a single lead discharging passage to selectively register with the lead cavities, the lead discharge member being cooperatively associated with the rod so as to discharge a piece of lead into the lead guiding passage means when the rod is depressed, said lead discharging passage permitting leads to fall into the lead guiding passage means when the rod is moved downward and then upward.

In one aspect of the invention, the lead discharge member is tubular and provided around the rod, having two helical slide grooves adjacent to the periphery of the rod, and the rod is provided with on the periphery thereof two projections which extend into the slide grooves.

In another aspect of the invention, the discharge member is tubular and provided around the rod, and the rod is provided with two opposite peripheral helical slide grooves. The discharge member further has two sliding projections which extend into the peripheral helical slide grooves.

In still another aspect of the invention, the tubular housing further has a chamber above the lead cavities, a locating member provided in the chamber, and a cap attached to the upper end of the tubular housing above the locating member. The rod has an upper portion which passes through the locating member and engages with both said locating member and said cap so as to rotate simultaneously therewith. The locating member has at a bottom side thereof protrusions which are engageable selectively with the lead cavities. The position of the protrusions determines the position of the lead discharge passage relative to the lead cavities. The urging means may be a helical spring provided between the cap and the locating member.

In still another aspect of the invention, the guiding passage means includes a plurality of intercommunicated passages in a number similar to that of the lead cavities, the intercommunicated passages converging downward and merging into a narrowed single lead guiding passage which extends to the lead outlet.

In still another aspect of the invention, the lead discharge member is cylindrical and has a plurality of upper teeth and lower teeth which extend axially and radially inward adjacent to the periphery of the rod, the upper teeth being axially spaced apart from and staggered with the lower teeth, each of the upper teeth or lower teeth having a leading side which is parallel to the axis of the lead discharge member and a lagging side which is inclined in relation to the axis, the upper teeth confining the upper wedge-shaped groove with therebetween, the lower teeth confining the lower wedge-shaped grooves therebetween, the upper and lower wedge-shaped grooves being staggered with one another. The rod is provided with two diametrically opposed projections to extend into the wedge-shaped grooves.

In still another aspect of the invention, the rod is provided with an annular zigzagged groove and axially extending V-shaped teeth to confine the zigzagged groove, and the lead discharge member has two opposed inward projections which extend into the zigzagged groove.

In still another aspect of the invention, the rod has a radial projection, and the lead discharge member is cylindrical, having a discharge piece which is pivotally mounted adjacent to the radial projection in the lead discharge member. The discharge piece swings about an axis which is offset from and normal to the rod and has an upper end and a lower end to be cammed by the radial projection so as to interrupt the passing of leads through the lead discharge passage.

In still another aspect of the invention, the tapered end portion is provided with an insert piece which has an upper truncated cone-shaped portion, an intermediate cylindrical portion and a lower truncated cone-shaped portion. The upper truncated cone-shaped portion has axial projections which are spaced apart and extend inwardly and upwardly to confine the lead guide passages. The intermediate cylindrical portion and the lower truncated portion are provided with axial splits and confine the single lead guide passage. The lower truncated portion has a bottom end terminating at the lead outlet. The present exemplary preferred embodiment will be described in detail with reference to the accompanying drawings, in which:

DETAILED DESCRIPTION OF THE PREFERRED EMBODIMENTS

Figure 1:
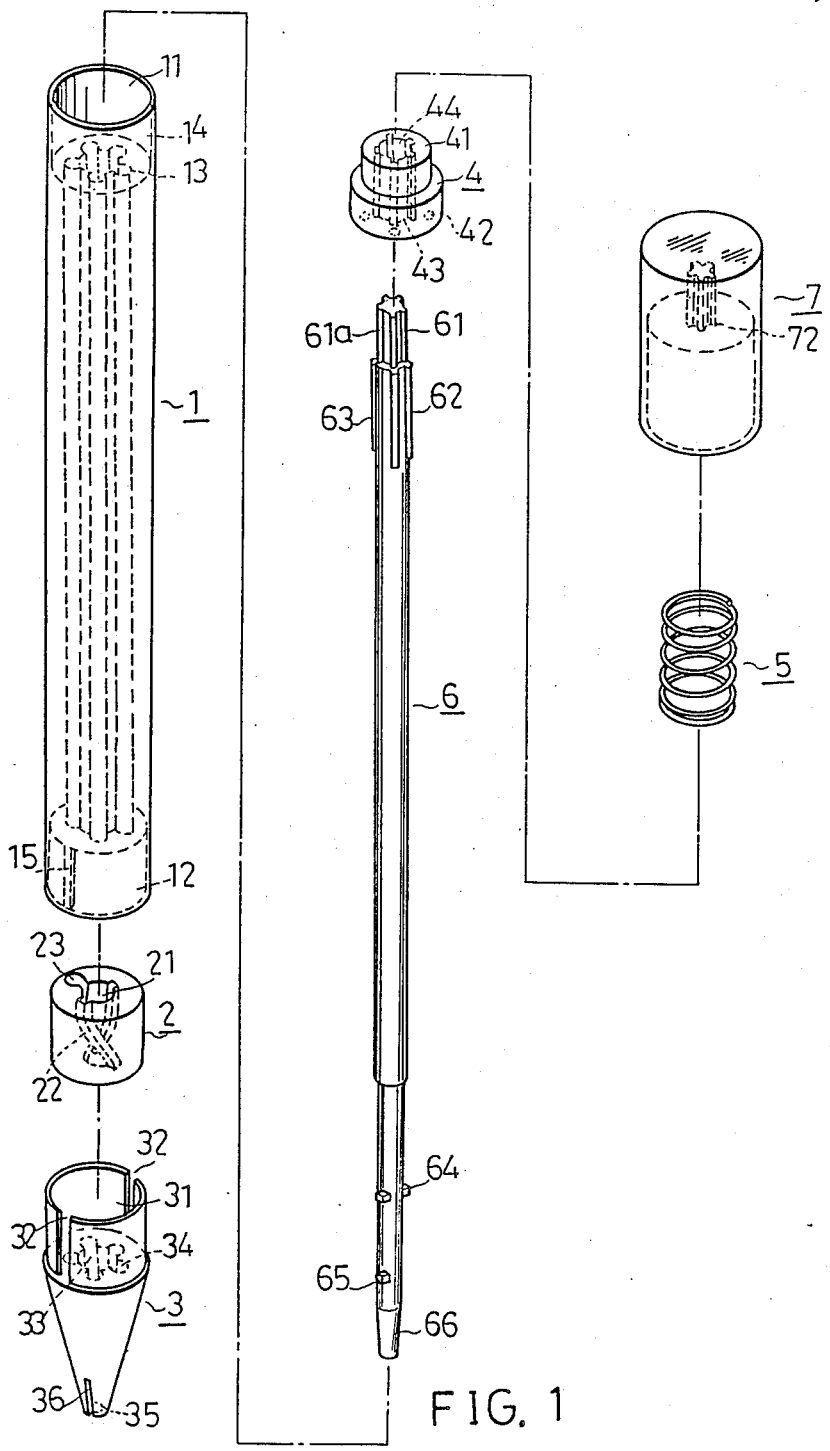
FIG. 1 is an exploded view of a first embodiment of a mechanical pencil according to the present invention.

The preferred embodiments of the present invention are described in the following drawings in which like elements are designated with like reference numerals.

Figure 2:
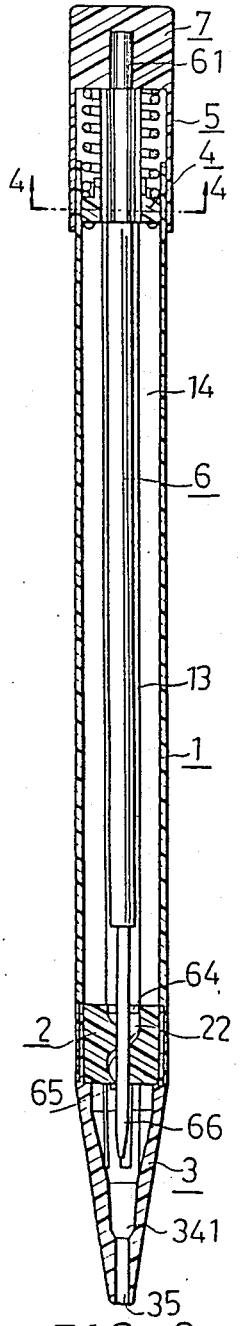
FIG. 2 is a sectional view of the pencil of FIG. 1.

Referring to FIGS. 1 and 2, a preferred embodiment of a mechanical pencil according to the present invention is shown, including an elongated tubular member which has an upper cavity 11, a lower cavity 12, a central elongated cavity 13 and five elongated cavities all of which extend between the upper and lower cavities 11, 12. The central cavity 13 receives an elongated operating rod 6 and the cavities 14 are arranged annularly around the central cavity 13 for receiving aligned pencil leads with their sharpened ends directing downward. In the lower cavity 12 is provided a positioning projection 15.

A cylindrical lead discharge member 2 which is placed in the lower cavity 12 of the tubular housing 1 and includes a central through-bore 21 and two diametrically opposed recesses 22 which extend longitudinally and helically. A lead discharging passage 23 is formed in the lead discharge member 2, extending radially from the central bore 21 and from the upper end to the lower end of the discharge member 2. The discharging passage 23 can be selectively aligned with one of the cavities 14. A tapered housing 3 is attached to the tubular housing 1 by means of the upper portion thereof which is fitted in the lower end of the tubular housing 1. The tapered housing 3 is prevented from rotating by the engagement of grooves 32 of the tapered housing 3 and the projections 15 of the tubular housing 1. At the end of the tapered housing 3 are provided a lead outlet 35 and splits 36. The tapered housing 3 has an upper cavity 31 and lower lead guiding passages 34 whose uppermost cross-section substantially conforms to that of the combined configuration of the cavities 13 and 14. The lead guiding passages 34 are intercommunicated and converge downward to a single narrow guide passage 341. The lead discharging passage 22 can also communicate with one of cavities 34 so that leads from the lead cavity 14 can be discharged into the passages 34 of the tapered housing 3. The rod 6 has a lower portion which is provided with a tapered push end 66, a stop projection 65 and two cam bosses 64. The lower portion of the rod 6 passes through the central bore 21 and extends into the tapered housing 3. The cam bosses 64 extend, into the helical recesses 22 of the cam member 2 so that the rod will be rotated when it is moved downward. The stop projection 65 engages with the bottom side of the cam member 2 so as to prevent further upward movement of the rod 6.

Figure 4:
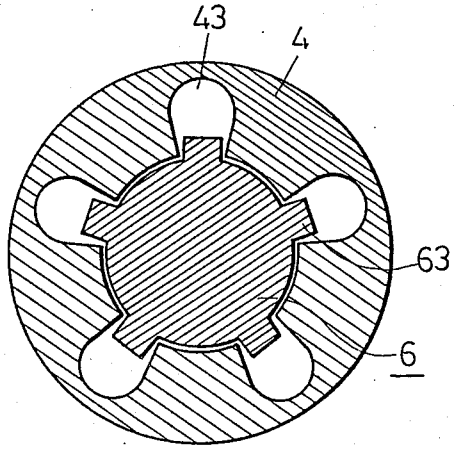
FIG. 4 is a sectional view taken along line 4—4 of FIG. 2.

The upper portion 62 of the rod 6 is provided with radial ridges 63 and a restricted portion 61. A locating member 4 is provided in the upper cavity 11 of the tubular housing 1 and has a bore 43 to receive the portion 62 of the rod 6. The cross-section of the bore 43 is arranged such that the bore 43 engages with the ridges 63 and prevent the rod 6 from rotation relative to the regulating member 4 but permits the rod 6 to slide longitudinally as better shown in FIG. 4. The regulating member 4 is further provided with protrusions 42 at the bottom side thereof which can be selectively engaged with the lead cavities 14. A cap 7, is attached to the upper end of the tubular housing 1 and ridges 61*a* of the restricted portion 61 are engaged with a recess 72 of the cap 7. A spring 5 is provided between the regulating member 4 and the cap 7 to urge the rod upward.

Figure 3:
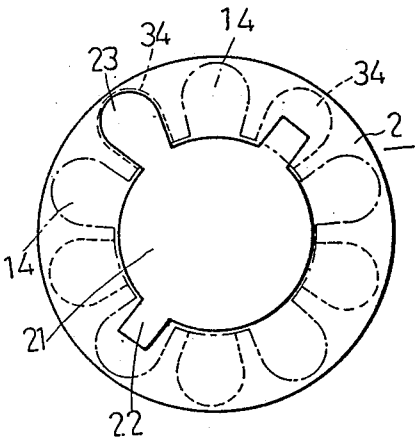
FIG. 3 is an elevation view showing the position of the lead discharge member relative to the lead cavities and the lead guide passages when the rod is depressed.
Figure 7:
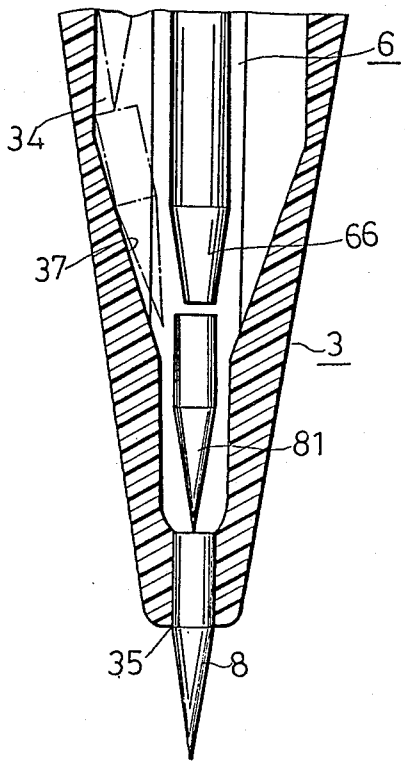
FIG. 7 is a fragmentary sectional view of the pencil of FIG. 1 when the pressure on the rod is removed.
Figure 6:
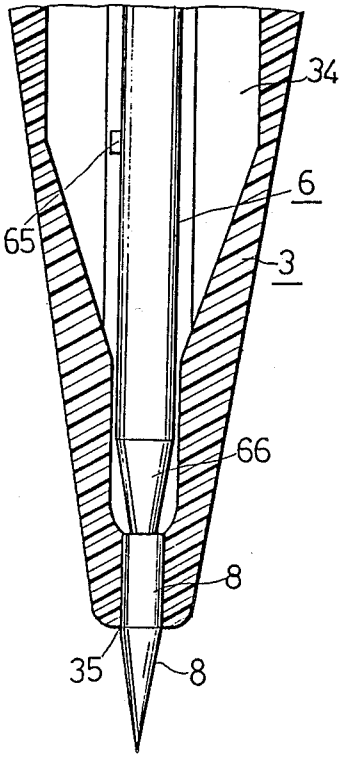
FIG. 6 is a fragmentary sectional view of the pencil of FIG. 1 when the rod is depressed.

Normally, the lead discharging passage 23 does not register with any one of the cavities 14 of the tubular housing 1, but registers with one of the cavities 34 of the tapered housing 3, as shown in FIG. 3. Therefore, no lead drops into the passage 23. When the rod is pressed downward, the ridges 63 of the upper portion 62 of the rod engage with the lead cavities 14, thereby preventing the rod 6 from rotation. At the same time, the projections 64 of the rod 6 move along the helical grooves 22, thereby turning the lead discharge member 6 at a certain angle and causing the lead discharging passage 23 to register with one of the cavities 14 of the housing 1, as shown in 5. In this situation, the lead discharge passage 23 does not register with the lead guiding passages 34 so that no lead enters the lead guiding passages 34. However, the push end 66 of the rod 6 pushes a piece of lead 8 which has previously discharged into the tapered housing 3, as shown in FIG. 6. On the other hand, a lead is dropped into the lead discharging passage 23 from the lead cavity 14. When the pressure on the cap 7 is removed, the rod 6 moves upward as shown in FIG. 7, and the lead discharge member 4 is returned to its original position in which the lead discharging passage 23 does not register with any lead cavity 14.

When the leads in one of the lead cavities 14 are used up, the position of the lead discharge member 4 can be changed so as to cause the lead discharge passage 23 to communicate with the next cavity 14 by turning the cap 7. The rod 6, the locating member 4 and the lead discharge member are turned simultaneously upon turning the cap 7. The lead discharge passage 23 reaches the next proper location when the protrusions 42 of the locating member 4 engage with next certain cavities 14 respectively.

Figure 8:
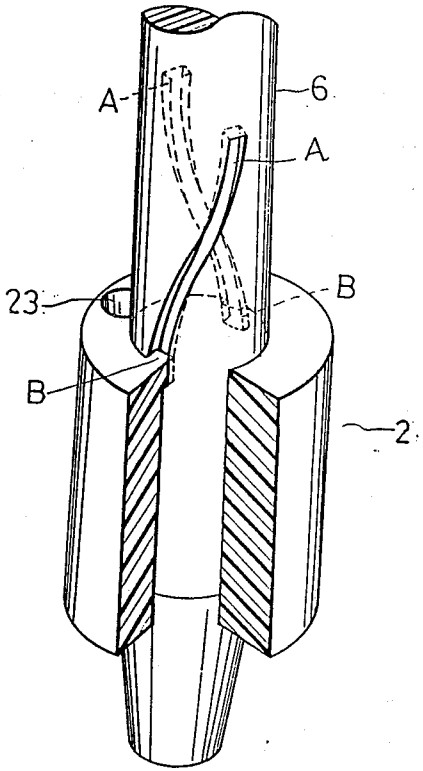
FIG. 8 is a perspective view of the lead discharge member and a portion of the rod of a second embodiment.

FIG. 8 shows a second embodiment which is substantially similar to the previous embodiment except that two helical slide grooves A are provided on the periphery of the rod 6 instead of on the locating member 4. The projections B extend into the helical slide grooves A. The operation of this embodiment is similar to that of the previous embodiment.

Figure 9:
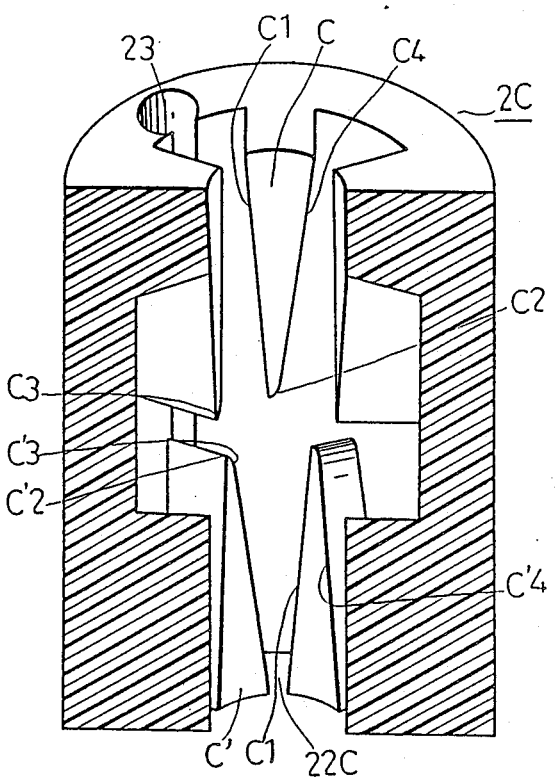
FIG. 9 is a partially sectioned perspective view of the lead discharge member of the third embodiment
Figure 5:
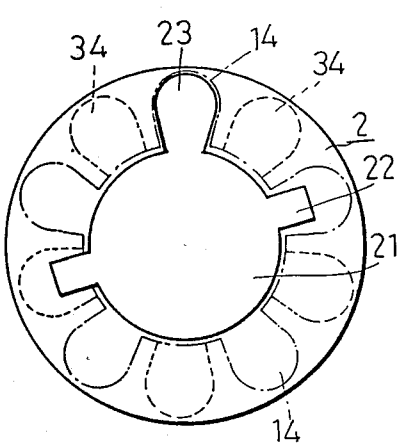
FIG. 5 is an elevation view showing the position of the lead discharge member relative to the lead cavities and the lead guide passages after the pressure on the rod is removed.
Figure 10:
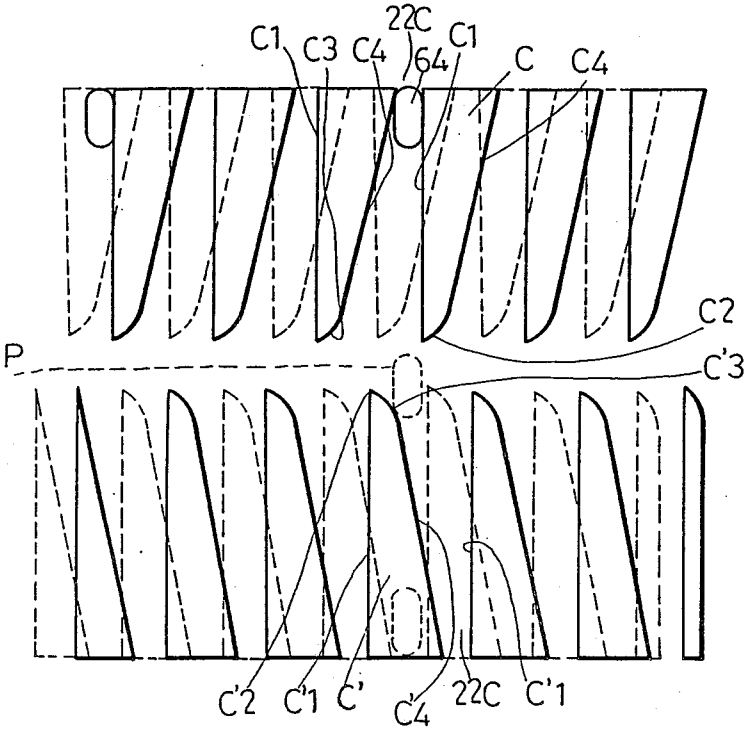
FIG. 10 is a partial development view of FIG. 9 showing the position of the projections of the rod and the teeth of the lead discharge member.

FIGS. 9 and 10 show a third embodiment of the invention which includes a locating member 2C different from that of the previous embodiments. The locating member 2C includes a plurality of upper cam teeth C and lower cam teeth C' which extend axially and radially inward adjacent to the periphery of the rod 6. The upper and lower cam teeth C and C' are axially spaced apart and staggered in relation to each other. Each of said upper or lower cam teeth C or C' has a leading side C1 or C'1 which extends parallelly with the axis of the locating member 4 and a lagging side C4 or C'4 which is inclined in relation to the axis of the locating member 4 and whose end meets the end of the leading side at C2 or C'2. Each side C4 or C'4 has a curved portion C3 or C'3. Two adjacent teeth C or C' confine a wedge-shaped groove 22C. Since the teeth C and C' are staggered in relation to one another upper and lower grooves 22C are also staggered in relation to one another.

In operation, the rod 6 is depressed to cause the projections 64 of the rod 6 to move in the grooves 22C. When the downward moving projections 64 pass the ends C2 of teeth C and reach the points "P", the projections 64 slide along the curved portion C'3 of teeth C' and enter the lower grooves 22C. Since the sides C'4 are inclined, the projections 64 cam the teeth C' to the positions shown by dotted lines, moving forward the lead discharge member 2C a certain distance and thereby causing the lead discharge passage 23 to communicate with one of the cavities 14. When the pressure on the rod is removed, the projections 64 move upward and enter respectively another upper grooves 22C which lead the previous upper grooves 22C. In this embodiment, the locating member 4 is not necessary because the lead discharge member 2 can communicate with the cavities 14 one after the other during the depressing operations of the rod 6 without additional means to adjust the position of the lead discharge member 4.

Figure 11:
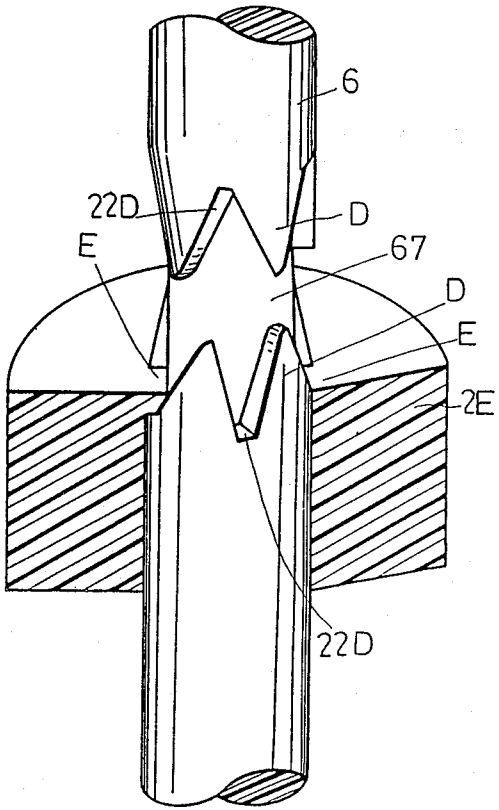
FIG. 11 is a perspective view of a portion of the fourth embodiment.

FIG. 11 shows a portion of a fourth embodiment of the present invention in which the rod 6 is provided with an annular zigzagged groove 67 and opposed axially extending upper and lower V-shaped camming teeth D which confine the groove 67. The lead discharge member is designated at 2E and provided with slide projections E which extend into the groove 67. The mechanical pencil of this embodiment functions in the same manner as the third embodiment. Whenever the rod 6 is depressed, the lead discharge member 2E is turned at a certain angle and the lead discharge passage 23 communicates with the next lead cavity 14 so that leads are discharged from all lead cavities 14 when the lead discharge member makes a turn.

Figure 12:
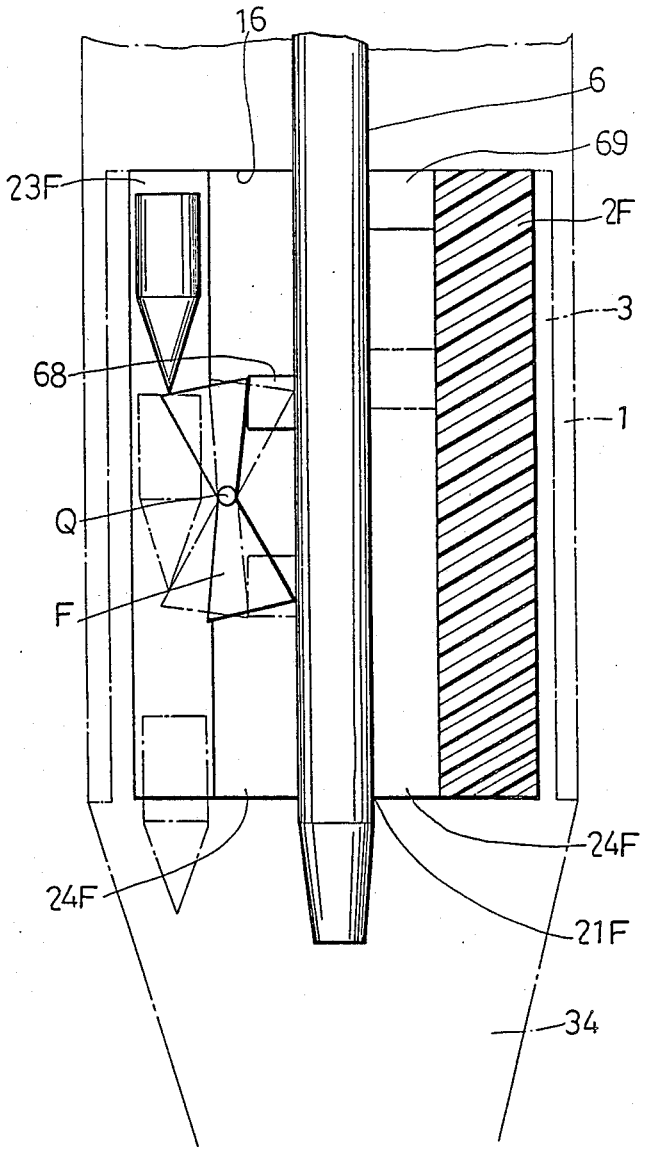
FIG. 12 is a sectional view of a portion of the fifth embodiment.

FIG. 12 shows a portion of the fifth embodiment of the invention in which the rod 6 is provided with a radial projection 68 and a stop member 69. A lead discharge member 2F is provided around the rod 6, which has a bore 21F receiving the rod 6, a lead discharge passage 23F and diametrically opposite grooves 24F extending from the bore 21F. The stop member 69 limits the rod 6 from moving further upward when the stop member 69 touches a bottom face 16 of the tubular housing 1. A discharge piece F is mounted pivotally about an axis Q which is offset from and normal to the axis of the rod 6. The radial projection 68 is moved between a first position in which the projection 68 pushes the upper side of the discharge piece F to the left so as to interrupt the falling of the lead into the passage 23F and permit the lead from the passage 23F to fall into the lead guide passage 34 and a second position in which the projection 68 pushes the lower side of the discharge piece F to the left so as to permit the lead from the lead cavity 14 to fall into the lead discharge passage and prevent the lead from falling into the lead guide passage 34 from the passage 23F. The pencil of this embodiment requires the locating member 4 of the first embodiment.

Figure 13:
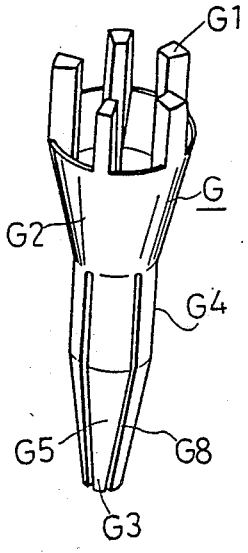
FIG. 13 is a perspective view of an insert member included in the sixth embodiment of the invention.
Figure 14:
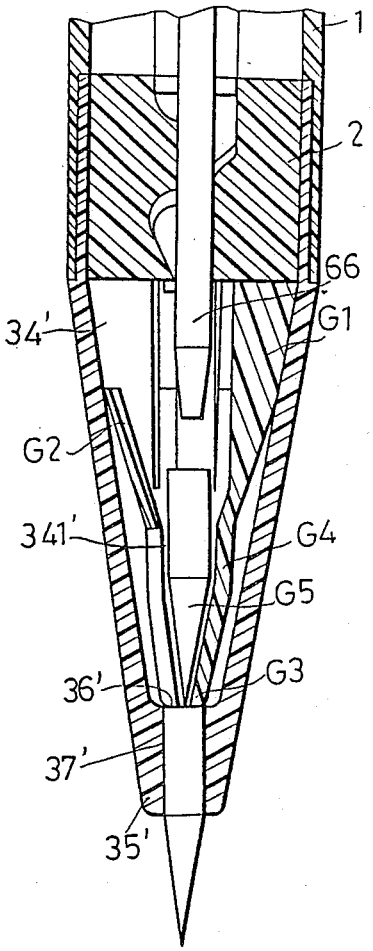
FIG. 14 is a sectional view of a portion of the sixth embodiment of the invention.

FIGS. 13 and 14 show a portion of the sixth embodiment of the invention which has an insert piece G provided in the lower tapered housing 3' of the pencil. The tapered housing 3' is hollow unlike the tapered housing 3 of FIG. 1 which has lead guiding passages 34. A thickened wall 37 is provided at the tip of the tapered housing 3' to confine an outlet 35'. The insert piece G includes a first truncated cone-shaped portion G2, a cylindrical portion G4 below the first portion G2 and a second truncated cone-shaped portion G5 below the cylindrical portion G4. Five axial teeth Gl extend upwardly and inwardly from the upper truncated cone-shaped portion G2 to confine the intercommunicated lead guide passages 34'. The intermediate cylindrical portion G4 and the lower truncated cone-shaped portion G5 confine a single lead guide passage 341'. There are splits G8 which extend from the cylindrical portion G4 to the second truncated cone-shaped portion G5 so that the portions G4 and G5 can serve as a resilient clamp member. The converged end G3 of the second truncated cone-shaped portion abuts with the inner face 36 of the thickened wall 37' in such a manner that the lead outlet 35' is blocked by the converged end G3.

Because of the resilient characteristic of the lower truncated portion G5 of the insert piece G, leads from the lead guide passage 341' can be pushed outward by the rod 6 through the end G3 of the insert piece G. However, the converged end G3 can completely prevent the lead which reaches the outlet 35' from moving inward. This effect eliminates the disadvantage of conventional mechanical pencils in which the lead at the outlet thereof is more or less moved inward when there is a pressure at the outlet, in other words, when the pencil is used.

With the invention thus explained, it is apparent that various modifications and variations can be made without departing from the scope of the present invention. It is therefore intended that the invention be limited only as indicated in the appended claims.

What I claim is:

1. A mechanical pencil comprising:

a tube-like housing having an upper end and a tapered bottom end portion, an elongated central cavity and a plurality of elongated lead cavities annularly provided around said central cavity, said lead cavities being adaptable for receiving aligned leads with their sharpened ends directed downward, said housing further having a lead discharge member receiving cavity below said central cavity and said lead cavities, said tapered end portion having a lead guiding passage means below said lead discharge member receiving cavity and a lead outlet;

an operating rod movably received in said central cavity, having an upper end and a lower end, said lower end extending into said lead guiding passage means;

means for urging said rod to move upward;

a lead discharge member provided in said lead discharge member receiving cavity, having a bore to permit said rod to pass therethrough and a single lead discharging passage to selectively register with said lead cavities, said lead discharge member being cooperatively associated with said rod so as to discharge a piece of lead into said lead guiding passage means when said rod is depressed, said lead discharging passage permitting leads to fall into said lead guiding passage means when said rod is moved downward and then upward.

2. A mechanical pencil as claimed in claim 1, wherein said lead discharge member is tubular and provided around said rod, having two helical slide grooves adjacent to a periphery of said rod, said rod being provided on said periphery with two projections which extend into said slide grooves.

3. A mechanical pencil as claimed in claim 1, wherein said lead discharge member is tubular and provided around said rod, and said rod is provided with two opposite peripheral helical slide grooves, said discharge member further having two sliding projections which extend into said peripheral helical slide grooves.

4. A mechanical pencil as claimed in claim 1, further comprising a chamber above said lead cavities, a locating member provided in said chamber, and a cap attached to said upper end of said tubular housing above said locating member, said rod having an upper portion which passes through said locating member and engages with both said locating member and said cap so as to rotate simultaneously therewith, said locating member having at a bottom side thereof protrusions which are engageable selectively with said lead cavities, said protrusions determining the position of said lead discharging passage relative to said lead cavities.

5. A mechanical pencil as claimed in claim 1, wherein said urging means is a helical spring provided between said cap and said locating member.

6. A mechanical pencil as claimed in claim 1, wherein said lead guiding passage means includes a plurality of intercommunicated passages in a number similar to that of said lead cavities, said intercommunicated passages converging downward and merging into a narrowed single lead guiding passage which extends to said lead outlet.

7. A mechanical pencil as claimed in claim 1, wherein said lead discharge member is cylindrical and has a plurality of upper teeth and lower teeth which extend axially and radially inward adjacent to a periphery of said rod, said upper teeth being spaced apart axially from and staggered with said lower teeth, each of said upper teeth or lower teeth having a leading side which is parallel to the axis of said lead discharge member and a lagging side which inclines in relation with said axis, said upper teeth confining upper wedge-shaped grooves therebetween, said lower teeth confining lower wedge-shaped grooves therebetween, said upper and lower wedge-shaped grooves being staggered with one another, said rod being provided with two diametrically opposed projections to extend into said wedge-shaped grooves.

8. A mechanical pencil as claimed in claim 1, wherein said rod is provided with an annular zigzagged groove and axially extending V-shaped teeth to confine said zigzagged groove, and said lead discharge member has two opposed inward projections which extend into said zigzagged groove.

9. A mechanical pencil as claimed in claim 1, wherein said rod has a radial projection, and said lead discharge member is cylindrical, having a discharge piece which is pivotally mounted adjacent to said radial projection in said lead discharge member, said discharge piece swinging about an axis which is offset from and normal to said rod and having an upper end and a lower end to be cammed by said radial projection so as to interrupt the passing of leads through said lead discharging passage.

10. A mechanical pencil as claimed in claim 6, wherein said tapered end portion is provided with an insert piece which has an upper truncated cone-shaped portion, an intermediate cylindrical portion and a lower truncated cone-shaped portion, said upper truncated cone-shaped portion having axial projections which are spaced apart and which extend inwardly and upwardly to confine said lead guiding passages, said intermediate cylindrical portion and said lower truncated portion confining said single lead guide passage and being provided with axial splits, said lower truncated portion having a bottom end terminating at said lead outlet to prevent reverse movement of the lead.

* * * * *

UNITED STATES PATENT AND TRADEMARK OFFICE

CERTIFICATE OF CORRECTION

PATENT NO. : 4,915,521

DATED : April 10, 1990

INVENTOR(S) : Lee-Fen Hwang

It is certified that error appears in the above-identified patent and that said Letters Patent is hereby corrected as shown below:

On the title page:

[54] Title, change "MECHANICAL PENCIL WITH ROTARY DISCHARGE MEMBER" to -- MECHANICAL PENCIL --.

[73] Assignee, delete "Saint Island International Patent and Law Offices, Taipei, Taiwan."

Column 1, line 14, before "provide" insert -- to --.

Column 3, line 7, after "embodiment" insert a semicolon.
Column 3, line 51, change "projections" to -- projection --.

Column 4, line 15, delete the comma after "7".
Column 4, line 32, after "in" insert -- FIG. --

Column 5, line 2, change "parallelly" to -- parallel --.
Column 5, line 24, after "respectively" delete "another".

Signed and Sealed this

Twenty-first Day of July, 1992

*Attest:*

DOUGLAS B. COMER

*Attesting Officer*

*Acting Commissioner of Patents and Trademarks*